US007195582B2

(12) United States Patent
Wu

(10) Patent No.: US 7,195,582 B2
(45) Date of Patent: Mar. 27, 2007

(54) ROCK CLIMBING APPARATUS

(76) Inventor: Yu Feng Wu, No. 133-12, Anhe Rd., Situn District, Taichung City 407 (TW)

( * ) Notice: Subject to any disclaimer, the term of this patent is extended or adjusted under 35 U.S.C. 154(b) by 156 days.

(21) Appl. No.: 11/110,662

(22) Filed: Apr. 21, 2005

(65) Prior Publication Data

US 2006/0240949 A1 Oct. 26, 2006

(51) Int. Cl.
*A63B 7/00* (2006.01)
*B65G 17/06* (2006.01)

(52) U.S. Cl. ..... 482/37; 482/51; 198/850

(58) Field of Classification Search ..... 482/35–37, 482/51, 57; 198/150–151
See application file for complete search history.

(56) References Cited

U.S. PATENT DOCUMENTS 2,042,764 A * 6/1936 Birch ..... 482/52
4,923,191 A * 5/1990 Persico ..... 482/52
5,112,043 A * 5/1992 Gilfillian, Jr. ..... 482/53
5,125,877 A * 6/1992 Brewer ..... 482/7
5,549,195 A * 8/1996 Aulagner et al. ..... 198/850
6,231,482 B1 * 5/2001 Thompson ..... 482/37
6,860,836 B1 * 3/2005 Wu ..... 482/37
7,051,870 B2 * 5/2006 Schoendienst et al. ..... 198/850

* cited by examiner

*Primary Examiner*—Jerome Donnelly
*Assistant Examiner*—Fenn C. Mathew
(74) *Attorney, Agent, or Firm*—Rosenberg, Klein & Lee

(57) ABSTRACT

A rock climbing apparatus including a support stand on which a main body frame is mounted. The main body frame has two lateral columns, several transverse support beams and several longitudinal support columns built between the lateral columns to serve as a support skeleton. A rotary mechanism is arranged in the main body frame, including at least two chains in parallel to the length of the main body frame, multiple transverse slats in parallel to the width of the main body frame and a power supply for driving the chains to circularly revolve. The longitudinal support columns of the main body frame are arranged in a position where the chains are positioned. Each longitudinal support column has a rib rail, whereby the link shafts of the chains are slidably leant on the rib rail. The transverse slats are fixed on the chains and immediately adjacent to each other. The chains are positioned near the middle of the transverse slats. The transverse slats can circularly revolve along the lateral columns. Several rocks are locked on one face of each transverse slat distal from the chains for a user to climb.

12 Claims, 12 Drawing Sheets

ROCK CLIMBING APPARATUS

BACKGROUND OF THE INVENTION

The present invention is related to a rock climbing apparatus, and more particularly to a lightweight rock climbing apparatus which has sufficient strength and can be easily assembled for personal or domestic rock climbing exercise.

Rock climbing has become a popular activity. However, natural outdoor rock field can be hardly found. Moreover, there is safety problem in real rock climbing. Therefore, many artificial rock fields have been built. However, the artificial rock field necessitates larger space and the equipments of the artificial rock field are expensive. Therefore, the cost for such rock climbing exercise is high.

U.S. Pat. Nos. 5,549,195, 5,125,877 and 5,919,117 disclose rock climbing apparatuses. In each of those rock climbing apparatuses, a caterpillar structure is arranged on a frame body. The caterpillar structure is connected with a transmission mechanism for restricting the rotational speed of the caterpillar structure. Two sides of the caterpillar structure are respectively disposed in the rails of the frame body via chains or rollers, whereby the caterpillar structure can circularly revolve along the rails. Multiple rocks are arranged on the caterpillar structure for a user to climb for rock climbing exercise.

In the caterpillar structure of the above rock climbing apparatus, simply two sides of the caterpillar structure bear the force, while the middle of the caterpillar structure totally lacks support structure. The rocks are positioned on the middle of the caterpillar structure. Therefore, when a user climbs the rocks, the application force will totally fall onto the middle of the caterpillar structure. In order to avoid swing or deformation of the caterpillar structure, the caterpillar structure is designed with quite strong structure for bearing all the application force in climbing.

For example, U.S. Pat. No. 5,549,195 discloses a caterpillar structure composed of multiple solid planks. U.S. Pat. No. 5,125,877 discloses a caterpillar structure composed of multiple metal frames pivotally connected with each other. A board body is inlaid in each metal frame. U.S. Pat. No. 5,919,117 discloses a caterpillar structure composed of multiple extruded board bodies pivotally connected with each other. In order to avoid deformation of the caterpillar structures, in all the above rock climbing apparatuses, the caterpillar structures are designed with quite strong and complicated structures. This results in that the rock climbing apparatus has a weight up to several hundred kilograms. Therefore, it is hard to move the rock climbing apparatus. In other words, such rock climbing apparatus is unsuitable for personal or domestic rock climbing exercise.

Furthermore, the frame body of the rock climbing apparatus is a huge and heavy structure for supporting the heavy caterpillar. Therefore, the rock climbing apparatus can be hardly assembled or transferred.

Besides, the caterpillar structure has gaps between the board bodies and the frames. These gaps are enlarged when the caterpillar is curved. A user's hairs, clothes, trousers or shoelaces may be chucked in the gaps to result in accident.

U.S. Pat. No. 6,860,836 of this applicant discloses a relatively lightweight rock climbing apparatus. A circularly rotating mechanism is mounted between two frames of a bed. The circularly rotating mechanism includes several sprockets. Each chain has multiple lugs arranged at intervals for mounting multiple transverse beams in parallel to the shaft. Two ends of each transverse beam are respectively inserted in open sides of the two frames. The transverse beams connected with the chains can be circularly revolved along the inner edges of the open sides of the frames. The chains and the transverse beams are wrapped with serially connected soft pads for shading the chains and the transverse beams. Multiple rocks are locked on outer sides of the soft pads corresponding to the lugs of the chains. Several U-shaped stopper boards are fixed between the frames corresponding to the chains, whereby the chains can lean on the stopper boards.

The chains can circularly revolve in a fixed path between the frames. The rocks are arranged on the chains which serve as the main supports for the rocks. Multiple transverse beams are arranged on the chains at intervals for bearing the outward pulling force exerted onto the rocks. The chains lean on the U-shaped seats for bearing the inward pushing force exerted onto the rocks. The above structure is simplified and the weight thereof is minified.

However, in practice, the above rock climbing apparatus still has some shortcomings. The rocks are fixed on the chains. When the rocks are forced inward, the lateral sides of two links of the chain abut against the U-shaped seat. When the chain revolves, the links and the U-shaped seat will abrade each other to produce noise. After a period of use, the links and the U-shaped seat will be worn out. This will affect the smoothness of the revolution and even the strength of the chain. In addition, when the rocks are forced outward, two ends of the transverse beam will abrade the open sides of the frames. Similarly, the transverse beam and the inner sides of the frames will be worn out and noise is produced.

Moreover, the above rock climbing apparatus is lightweight and suitable for personal or domestic use. However, the frames still have a considerable length exceeding the height of an adult for a user climb. The frames are divided into two segments. However, the segments can be hardly conveniently DIY assembled. Furthermore, there is no support structure between the frames. The entire structure is simply supported by the bed. Therefore, the strength of the rock climbing apparatus is still insufficient.

Besides, the transverse beams are arranged at intervals. Therefore, a gap is defined between two transverse beams. Although the transverse beams are wrapped with the soft pads, a user still often touches the gaps when climbing. At this time, the soft pads will be depressed to contact with the chains or the skeleton inside the frame. Under such circumstance, the inner faces of the soft pads will be abraded and worn out by the chains or the skeleton of the frame.

In addition, the soft pads must have a certain tightness to keep the surface smooth. However, the transverse beam is wrapped with the soft pad and fixed on the chain via the rock. When the transverse beam is revolved to the sprocket, the transverse beam will be tangential to the circumference of the sprocket. Accordingly, two ends of the transverse beam will lift the soft pad as shown in FIG. 12. At this time, the soft pad will be tensioned. In some cases, the soft pad will be broken in the position where the rock is fixed. In some serious cases, the chain will be unable to revolve. In the case that the soft pad is made of a resilient material, the inner face of the soft pad will be abraded by the chain or the skeleton of the frame. As a result, after a period of use, the soft pad will elastically fail due to the continuous tension.

SUMMARY OF THE INVENTION

It is therefore a primary object of the present invention to provide a rock climbing apparatus including a support stand on which a main body frame is mounted. The support stand serves to support and the main body frame on the ground. The main body frame is an elongated rectangular frame body. Two sides of the main body frame respectively have two lateral columns with substantially C-shaped cross-section. The opposite faces of the lateral columns are respectively formed with two open sides. Several transverse support beams and several longitudinal support columns are built between the open sides of the lateral columns of the main body frame to serve as a support skeleton of the main body frame. A rotary mechanism is arranged in the main body frame. The rotary mechanism includes at least two chains in parallel to the length of the main body frame, multiple transverse slats in parallel to the width of the main body frame and a power supply for driving the chains to circularly revolve. Each chain is composed of multiple links and link shafts. The chains are positioned near the middle of the main body frame. The longitudinal support columns of the main body frame is arranged in a position where the chains are positioned. Each longitudinal support column has a rib rail corresponding to the link shafts of the chain, whereby the link shafts are slidably leant on the rib rail. The transverse slats are fixed on the chains and immediately adjacent to each other. The chains are positioned near the middle of the transverse slats. Two ends of each transverse slat respectively extend into the open sides of the lateral columns of the main body frame, whereby the transverse slats can circularly revolve along inner edges of the open sides. Several rocks are locked on one face of each transverse slat distal from the chains, whereby a user can climb the rocks with hands and feet.

All the rocks are fixed on the transverse slats which are driven by the chains. Therefore, when a user climbs and treads the rocks, the longitudinal application force will be borne by the chains. In addition, the chains lean on the longitudinal support columns of the main body frame. Therefore, when the user climbs the rocks, the force directed to the main body frame will be borne by the longitudinal support columns. The link shafts of the chains slidably lean on the rib rails of the longitudinal support columns. Therefore, the friction between the chains and the longitudinal support columns is reduced, whereby even under greater longitudinal application force, the chains can still smoothly revolve. Moreover, the chains are positioned near the middle of the transverse slats so that the strength of the middle of the transverse slats is enhanced. Accordingly, it is no more necessary to design the transverse slats with heavy or solid structure as the conventional caterpillar structure. Instead, the transverse slats can be lighter or hollow structures so as to greatly minify the weight of the entire rock climbing apparatus.

It is a further object of the present invention to provide the above rock climbing apparatus in which several transverse support beams and several longitudinal support columns are built between the lateral columns of the main body frame to serve as transverse and longitudinal supports. Therefore, the strength of the main body frame is greatly enhanced. The middle section of the main body frame is pivotally disposed between the two lateral supports of the support stand. The main body frame is composed of several frame bodies which can be conveniently personally or domestically assembled. In addition, the main body frame can be disassembled into several frame bodies so as to minify the volume and facilitate the transfer.

It is still a further object of the present invention toprovide the above rock climbing apparatus in which the transverse slats are immediately adjacent to each other and fixed on the chains. Therefore, the transverse slats can shade the transverse support beams, the longitudinal support columns and the chains arranged inside the frame body frame. In addition, the resilient strips are disposed on the sidewalls of the transverse slats, whereby the resilient strips of the adjacent transverse slats can resiliently abut against each other so as to block the gap between the adjacent transverse slats. Therefore, the hairs or clothes of a user is prevented from being chucked in the gap. Accordingly, the conventional soft pad can be omitted to eliminate the shortcomings caused by the soft pad.

It is still a further object of the present invention to provide the above rock climbing apparatus in which the transverse slats are immediately adjacent to each other and fixed on the chains. When the transverse slats revolve to the shaft rods, the adjacent transverse slats will depart from each other to form a gap. Several polygonal stopper blocks are arranged on the shaft rods for blocking the gaps between the adjacent transverse slats so as to prevent the user's feet from incautiously extending into the gaps. Therefore, the safety in use can be ensured.

It is still a further object of the present invention to provide the above rock climbing apparatus in which an antiwear jacket is fitted on each end of the transverse slat extending into the lateral column of the main body frame. The antiwear jacket is made of antiwear material. Therefore, when the transverse slat circularly revolves along the inner edges of the open sides of the lateral columns, the antiwear jackets abut against the inner edges of the open sides to enhance the lubrication and reduce the noise caused by friction.

The present invention can be best understood through the following description and accompanying drawings wherein:

DETAILED DESCRIPTION OF THE PREFERRED EMBODIMENTS

Please refer to FIGS. 1 to 5. The rock climbing apparatus of the present invention includes a support stand 1 having a base 11 rested on the ground. Two lateral supports 12 respectively upward extend from two sides of the base 11. A main body frame 2 is pivotally mounted between the two lateral supports 12.

Figure 1:
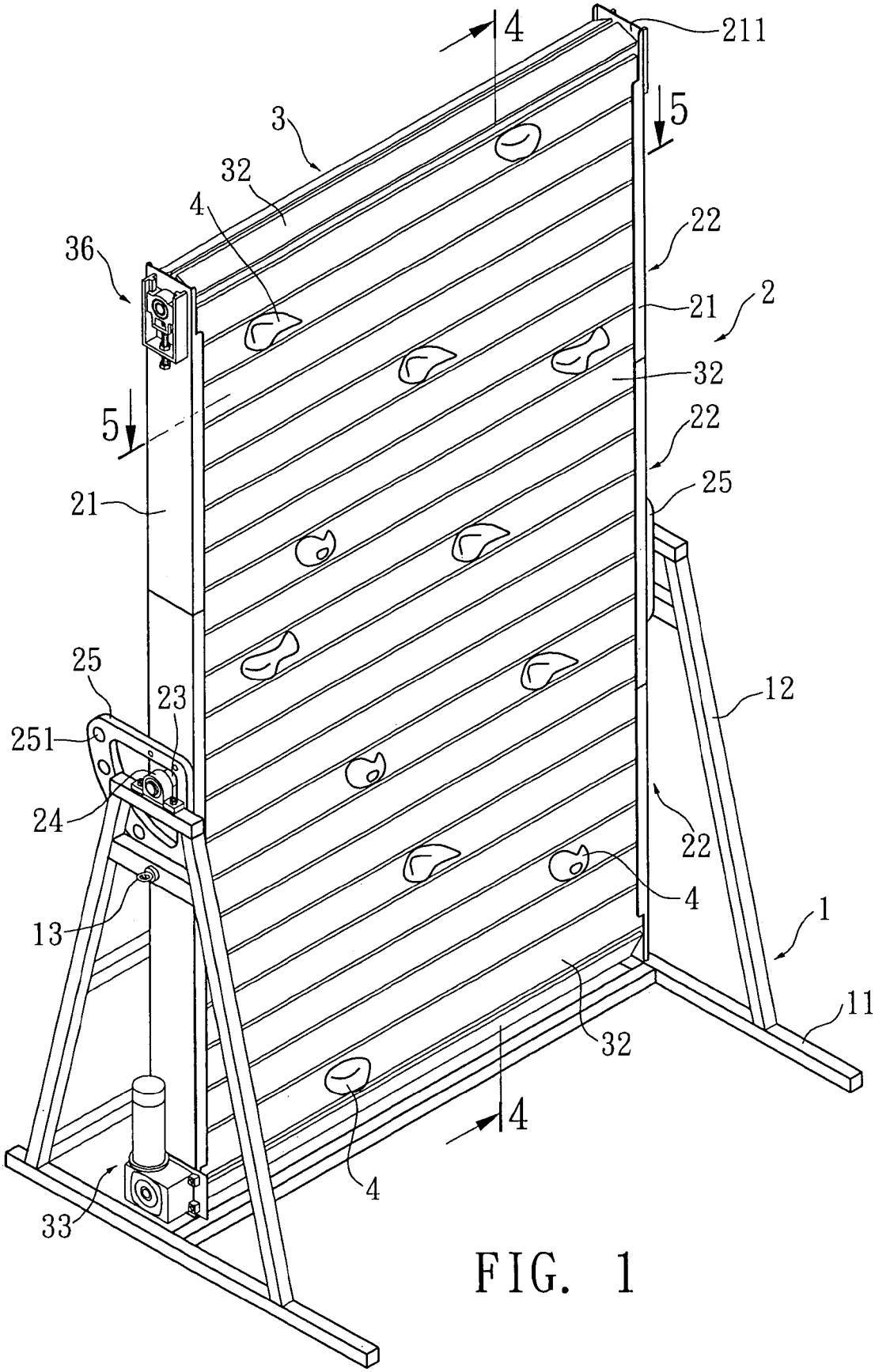
FIG. 1 is a perspective assembled view of the present invention.
Figure 2:
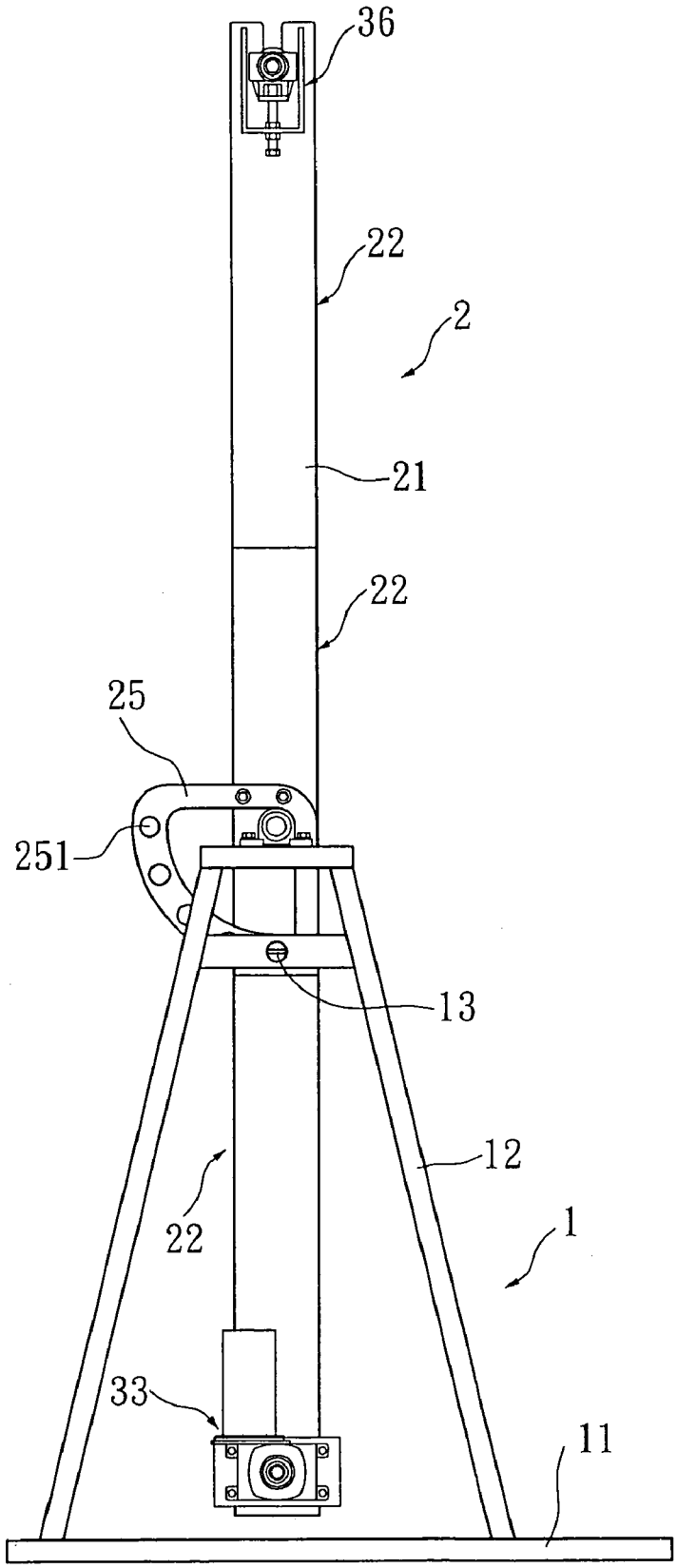
FIG. 2 is a side view of the present invention.
Figure 3:
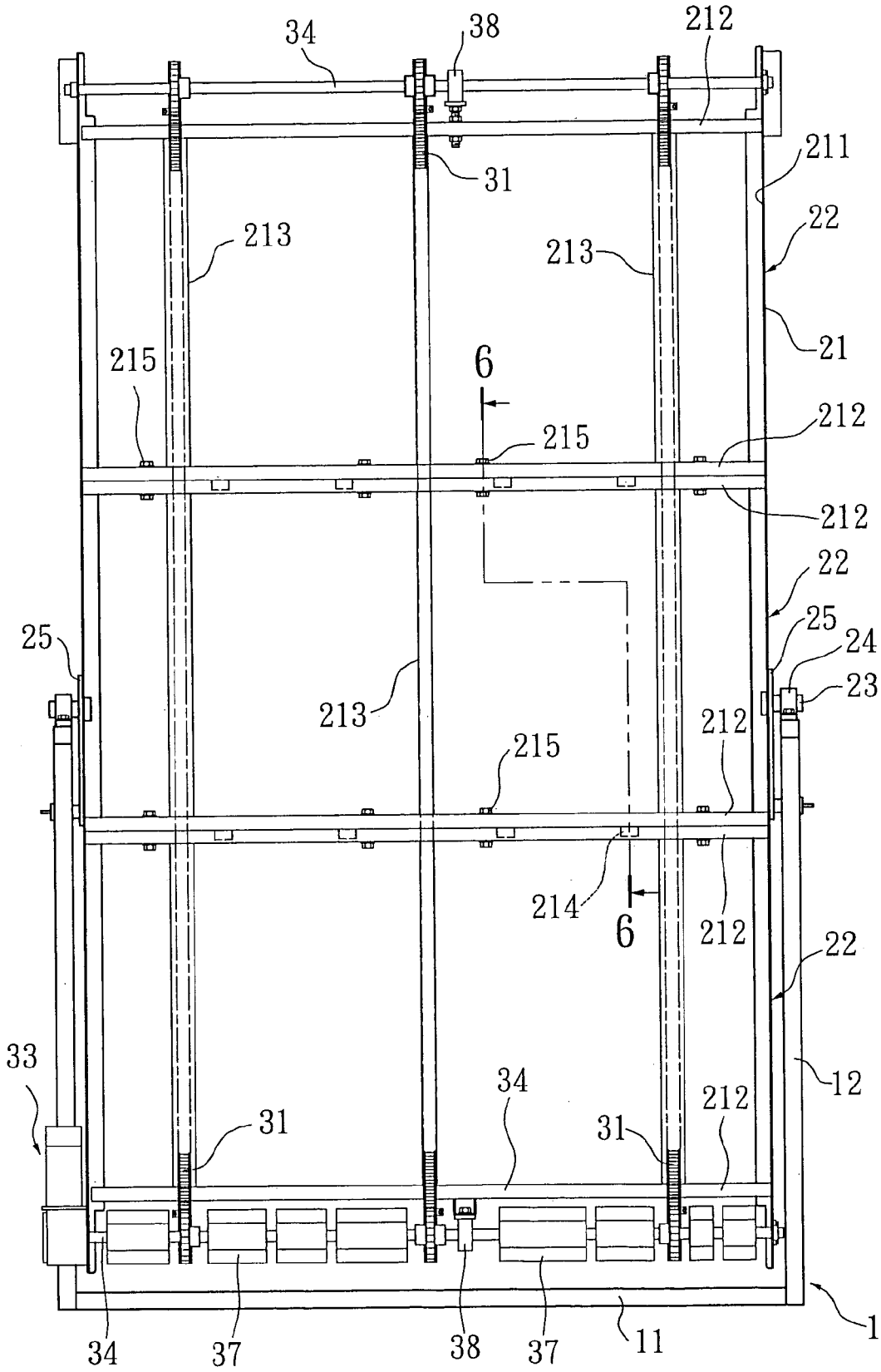
FIG. 3 shows the internal structure of the main body frame and the position of the chains of the present invention.
Figure 4:
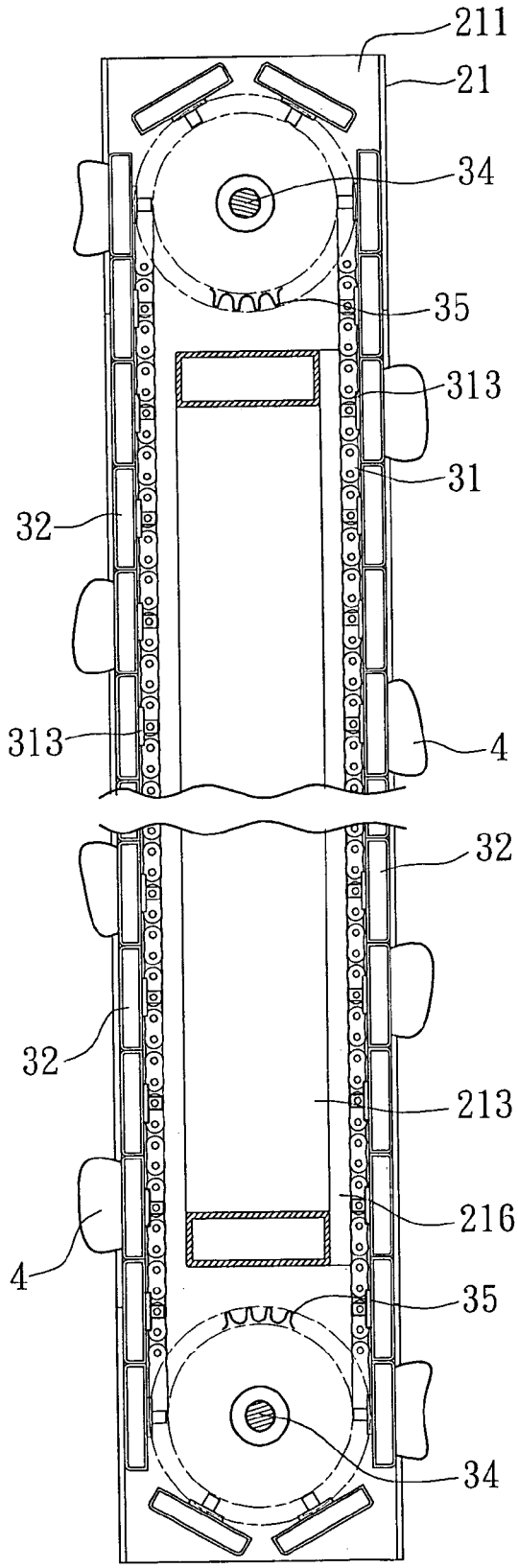
FIG. 4 is a sectional view taken along line 4—4 of FIG. 1.
Figure 5:
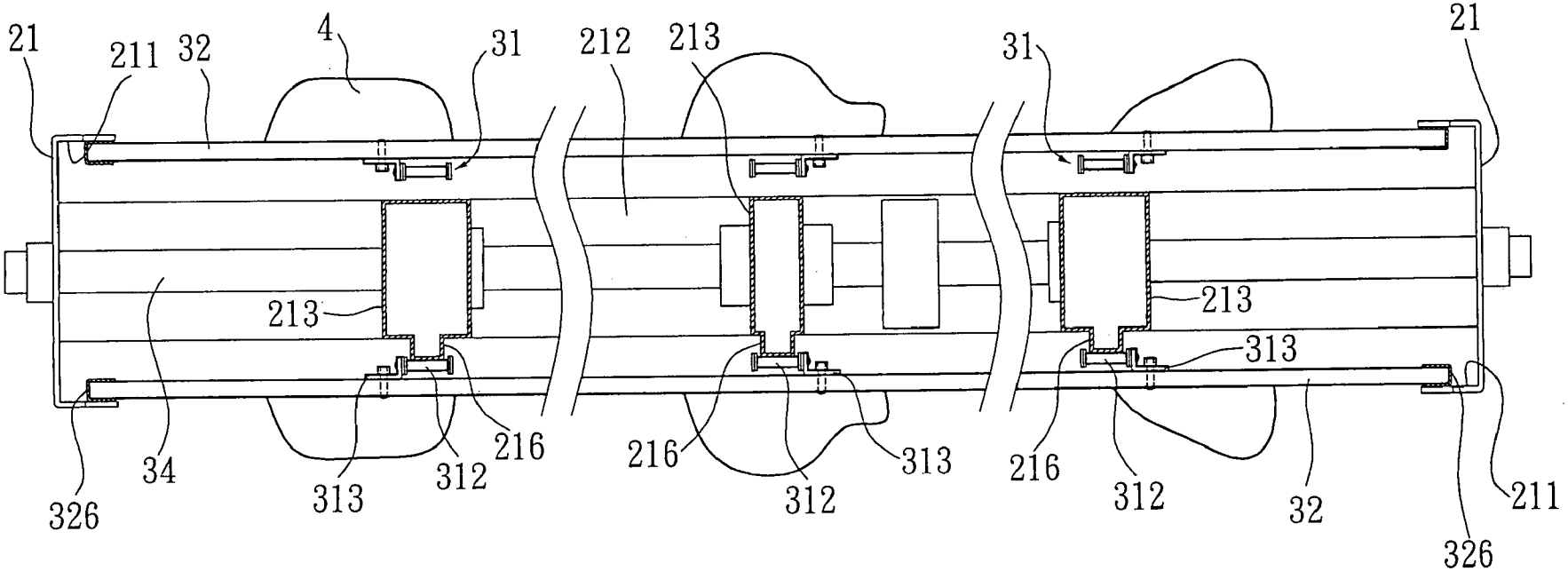
FIG. 5 is a sectional view taken along line 5—5 of FIG. 1.
Figure 6:
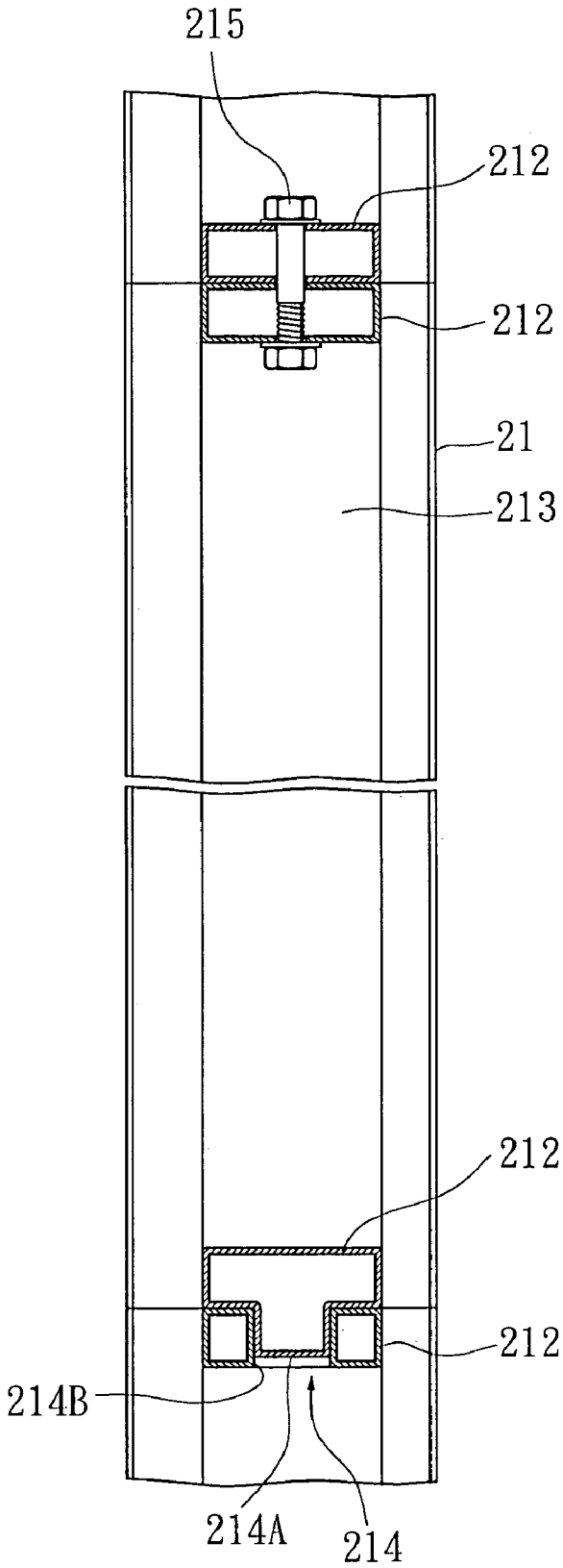
FIG. 6 is a sectional view taken along line 6—6 of FIG. 3.

The main body frame 2 is an elongated rectangular frame body composed of several frame bodies. The main body frame 2 has two lateral columns 21 with substantially C-shaped cross-section. The opposite faces of the lateral columns 21 are formed with open sides 211. Several transverse support beams 212 and several longitudinal support columns 213 are built between the lateral columns 21 to serve as a support skeleton of the main body frame. In this embodiment, the main body frame 2 is composed of an upper, a middle and a lower frame bodies 22. Each frame body 22 has transverse support beams 212 and longitudinal support columns 213. The adjacent transverse support beams 212 of the frame bodies 22 abut against and attach to each other to connect the frame bodies 22. Several locating members 214 and several fixing members 215 are disposed on the connected transverse support beams 212. In this embodiment, the locating member 214 includes a boss 214A and a hole 214B in which the boss 214A is inserted as shown in FIG. 6. The boss 214A and the hole 214B are respectively formed on the connected transverse support beams 212 for locating and assembling the frame bodies 22 into the main body frame 2. Two pivot shafts 23 respectively protrude from two sides of the middle frame body 22. The pivot shafts 23 cooperate with two shaft seats 24 to pivotally connect the middle frame body 22 with the lateral supports 12 of the support stand 1. In addition, two adjustment plates 25 are respectively disposed on two sides of the middle frame body 22. Each adjustment plate 25 has several adjustment holes 251. Each lateral support 12 of the support stand 1 has an insertion pin 13 corresponding to the adjustment hole 251 of the adjustment plate 25. The insertion pin 13 can be inserted into the adjustment hole 251 to fix the main body frame 2 in an inclined position.

The rock climbing apparatus of the present invention further includes a rotary mechanism 3 arranged in the main body frame 2. The rotary mechanism 3 includes at least two chains 31 in parallel to the length of the main body frame 2, multiple transverse slats 32 in parallel to the width of the main body frame 2 and a power supply 33 for driving the chains 31 to circularly revolve. Each chain 31 is composed of multiple links 311 and link shafts 312. The chains 31 are positioned near the middle of the main body frame 2. The longitudinal support columns 213 of the main body frame 2 are arranged in a position where the chains 31 are positioned. Each longitudinal support column 213 has a rib rail 216 corresponding to the link shafts 312 of the chain 31, whereby the link shaft 312 is slidably leant on the rib rail 216. The transverse slats 32 are fixed on the chains 31 and immediately adjacent to each other. The chains 31 are positioned near the middle of the transverse slats 32.

Figure 7:
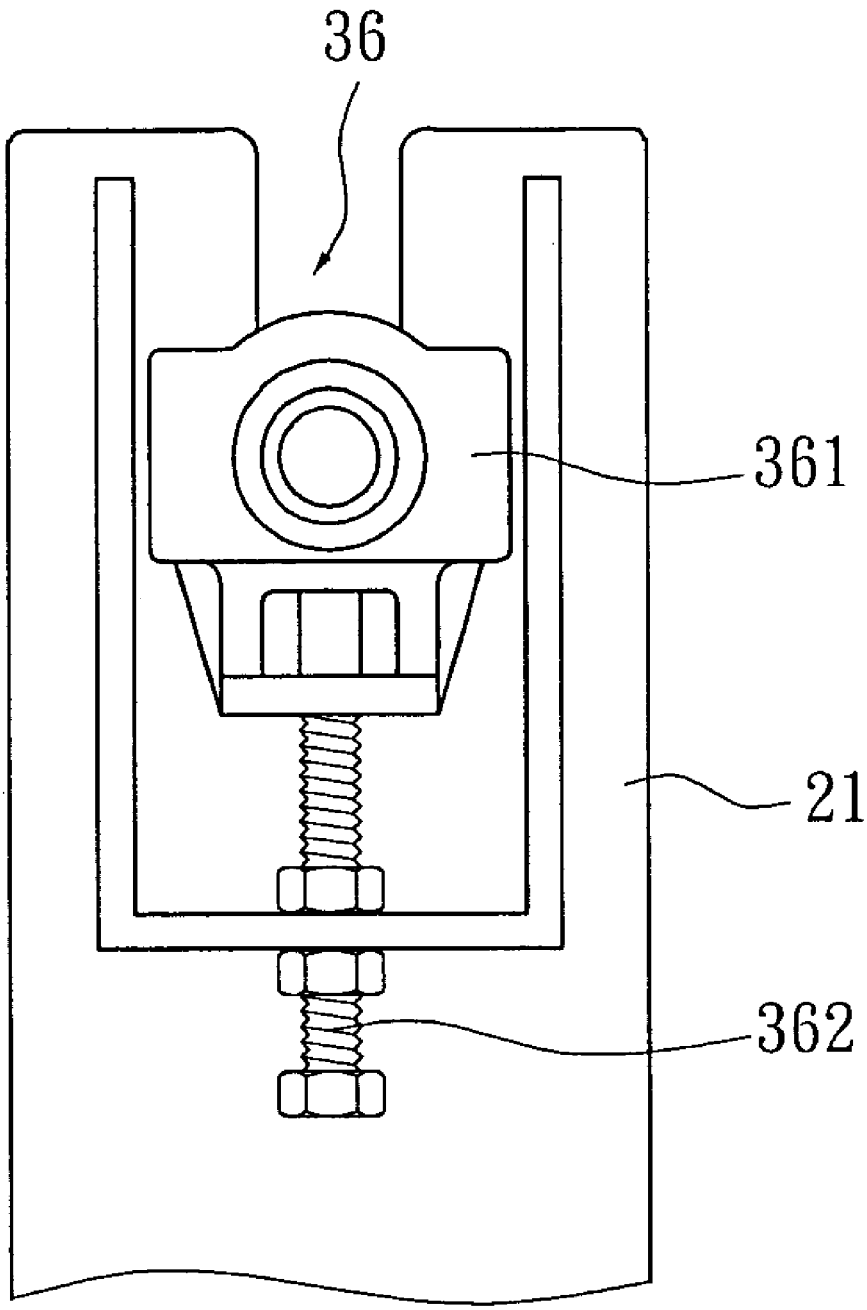
FIG. 7 shows the structure of the tension adjustment unit of the present invention.
Figure 8:
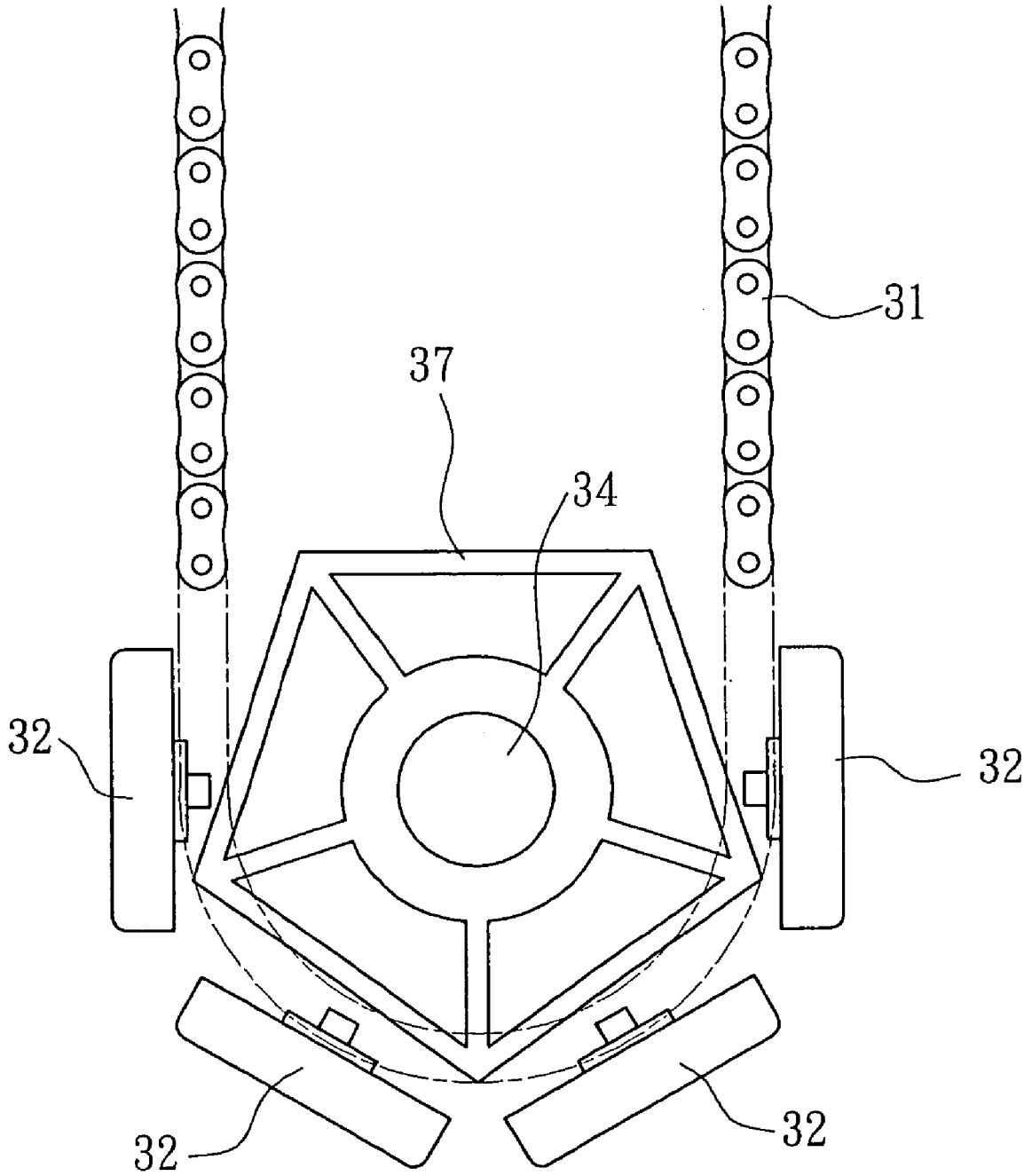
FIG. 8 shows the structure of the stopper block of the present invention.

In this embodiment, the rotary mechanism 3 includes three chains 31 in parallel to the length of the main body frame 2. The rotary mechanism 3 further includes two shaft rods 34, several sprockets 35 disposed on the shaft rods 34 corresponding to the chains 31 and a tension adjustment unit 36 for adjusting the tension of the chains 31. The shaft rods 34 are connected between two sides of the main body frame 2 in parallel to each other. The middle of each shaft rod 34 is retained by several support members 38. Each chain 31 is wound around a pair of corresponding sprockets 35. Each chain 31 has multiple lugs 313 arranged at intervals and connected with the links 311 for locking the transverse slats 32. Two ends of each transverse slat 32 respectively extend into the open sides 211 of the lateral columns 21 of the main body frame 2, whereby the transverse slats 32 can circularly revolve along the inner edges of the open sides 211. The tension adjustment unit 36 includes a movable seat 361 pivotally connected at each end of one shaft rod 34. The movable seat 361 is movable along the lateral column 21 of the main body frame 2. An axially extensible adjustment bolt 362 is disposed under the movable seat 361 as shown in FIG. 7. The adjustment bolt 362 is extensible to change the position of the movable seat 361, whereby the tension of the chains 31 is adjustable. The power supply 33 is a frequency-changing motor with a reducer. The power supply 33 is mounted at one end of the other shaft rod 34 and connected with the shaft rod 34 for driving the shaft rod 34 to rotate and further driving the chains 31 to circularly revolve. The frequency-changing motor can adjust the rotational speed of the chains 31. Several stopper blocks 37 are disposed on the body of the shaft rod 34 with the power supply 33. In this embodiment, each stopper block 37 has a polygonal cross-section as shown in FIG. 8 for blocking the gap between the adjacent transverse slats 32 when revolving to the shaft rod 34.

Figure 9:
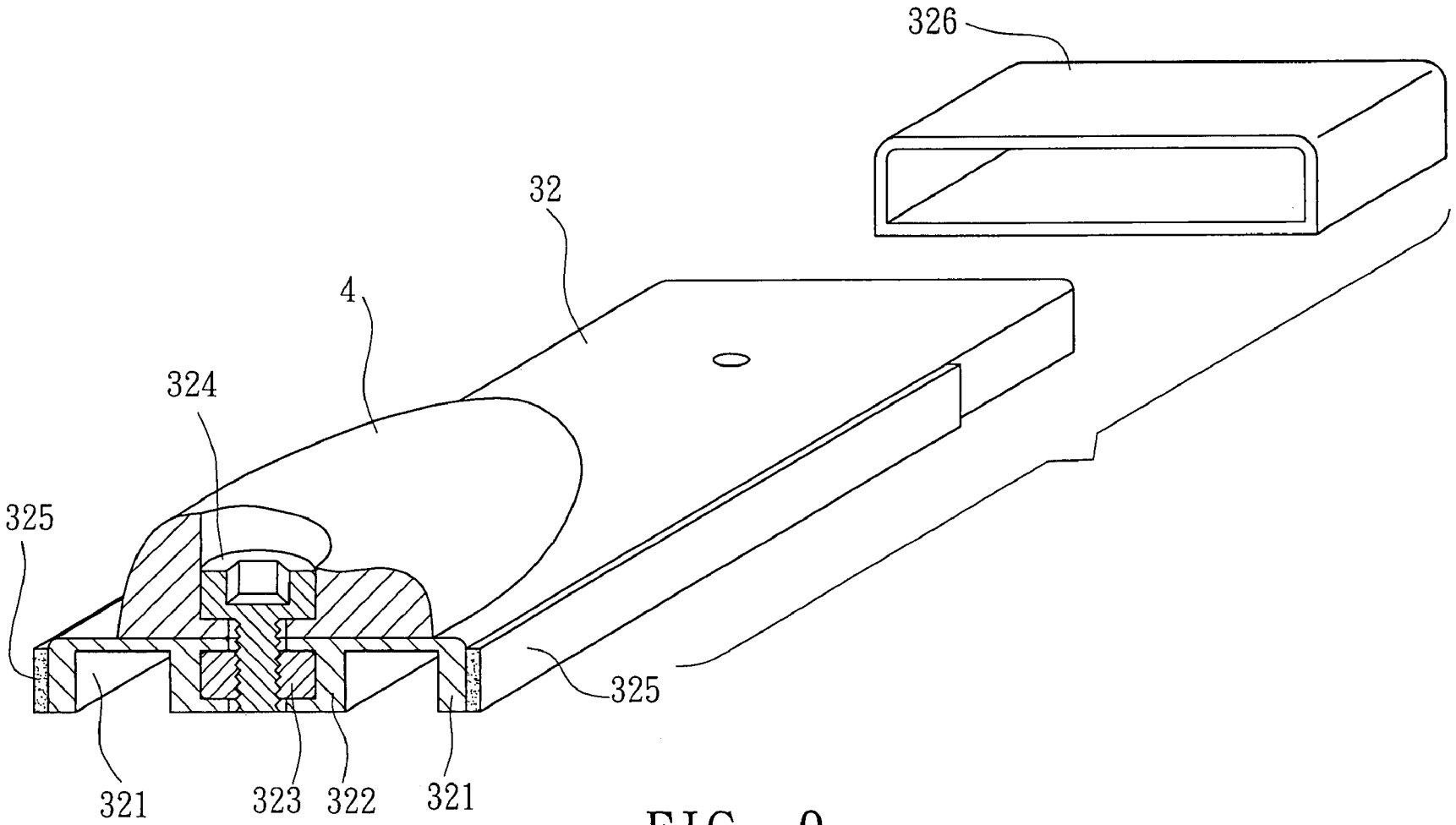
FIG. 9 shows the structure of the transverse slat of the present invention.

Several rocks 4 are locked on one face of each transverse slat 32 distal from the chains 31, whereby a user can climb the rocks. 4. In this embodiment, the transverse slat 32 is an elongated slat made by extrusion. The cross-section of the transverse slat 32 is substantially U-shaped as shown in FIG. 9. Each transverse slat 32 has two sidewalls 321 respectively perpendicularly extending from two sides of the transverse slat 32. In addition, each transverse slat 32 has a receiving seat 322 lengthwise extending between the sidewalls 321 in parallel thereto. Several nuts 323 are accommodated in the receiving seat 322, whereby several bolts 324 can extend through the rocks 4 to screw into the nuts 323 for fixing the rocks 4 on the transverse slat 32. A soft resilient strip 325 is disposed on each sidewall 321 of the transverse slat 32 for abutting against another resilient strip 325 of an adjacent transverse slat 32. Therefore, the gap between the adjacent transverse slats 32 can be blocked. In addition, an antiwear jacket 326 is fitted on each end of the transverse slat 32 extending into the lateral column 21 of the main body frame 2. When the transverse slat 32 circularly revolves along the inner edges of the open sides 211 of the lateral columns 21, the antiwear jackets 326 abut against the inner edges of the open sides 211 to enhance the lubrication and reduce the noise caused by friction.

The power supply 33 of the rotary mechanism 3 serves to drive the chains 31 to revolve. Accordingly, the transverse slats 32 are driven to circularly revolve along the length of the main body frame 2. Therefore, the positions of the rocks 4 fixed on the transverse slats 32 are changeable. In addition, the rotational speed of the chains 31 is adjustable by means of the frequency-changing motor of the power supply 33. Therefore, a user can climb the rocks 4 the positions of which are continuously varied so as to achieve an exercising effect.

The rocks 4 are all fixed on the transverse slats 32 which are driven by the chains 31. Therefore, when a user climbs and treads the rocks 4, the longitudinal application force will be borne by the chains 31. In addition, the chains 31 lean on the longitudinal support columns 213 of the main body frame 2. Therefore, when the user climbs the rocks 4, the force directed to the main body frame 2 will be borne by the longitudinal support columns 213. The link shafts 312 of the chains 31 slidably lean on the rib rails 261 of the longitudinal support columns 213. Therefore, the friction between the chains 31 and the longitudinal support columns 213 is reduced, whereby even under greater longitudinal application force, the chains 31 can still smoothly revolve. Moreover, the chains 31 are positioned near the middle of the transverse slats 32 so that the strength of the middle of the transverse slats 32 is enhanced. Accordingly, it is no more necessary to design the transverse slats 32 with heavy or solid structure as the conventional caterpillar structure. Instead, the transverse slats 32 can be lighter or hollow structures so as to greatly minify the weight of the entire rock climbing apparatus.

Figure 10:
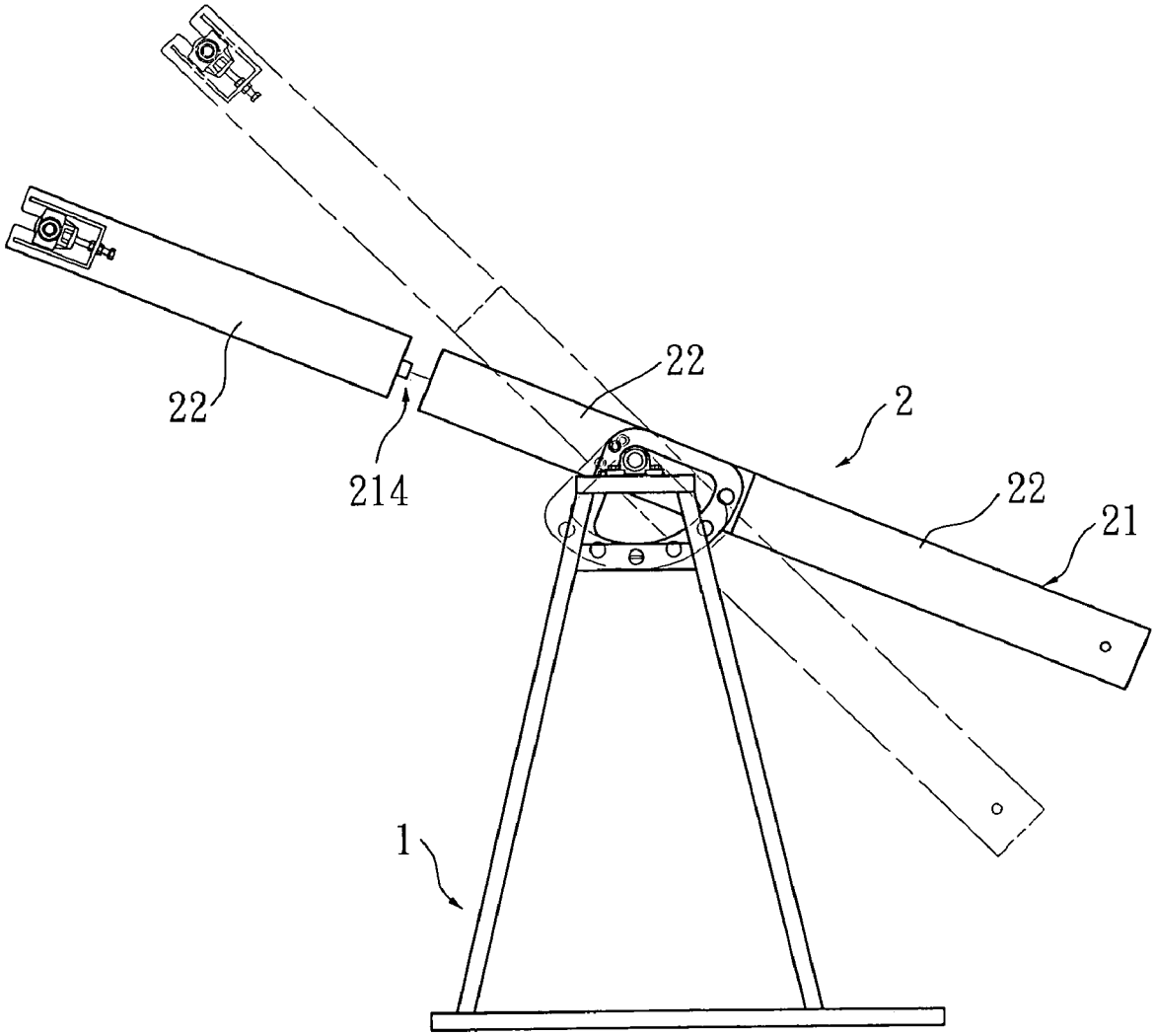
FIG. 10 shows the assembly of the present invention.

Furthermore, several transverse support beams 212 and several longitudinal support columns 213 are built between the lateral columns 21 of the main body frame 2 to serve as transverse and longitudinal supports. Therefore, the strength of the main body frame 2 is greatly enhanced. The middle section of the main body frame 2 is pivotally disposed between the two lateral supports 12 of the support stand 1. The main body frame 2 is composed of three frame bodies 22 which are easily assembled by means of simple locating and fixing structures. When assembled, as shown in FIG. 10, the middle frame body 22 is first pivotally mounted between the two lateral supports 12. Then, by means of the adjustment plate 25, the middle frame body 22 is adjusted to an approximately horizontal state. Then, by means of the locating members 215 and the fixing members 215, the upper and lower frame bodies 22 are sequentially connected and fixed with the middle frame body 22. Then the chains 31 and the transverse slats 32 are sequentially assembled. Finally, the power supply 33 and the shaft rods 34 are connected and the tension adjustment unit 36 is adjusted to adjust the tension of the chains 31. At this time, the assembly is complicated. Such assembling procedure can be conveniently personally or domestically accomplished. In addition, the main body frame 2 can be disassembled into three frame bodies 22 so as to minify the volume and facilitate the transfer.

Figure 11:
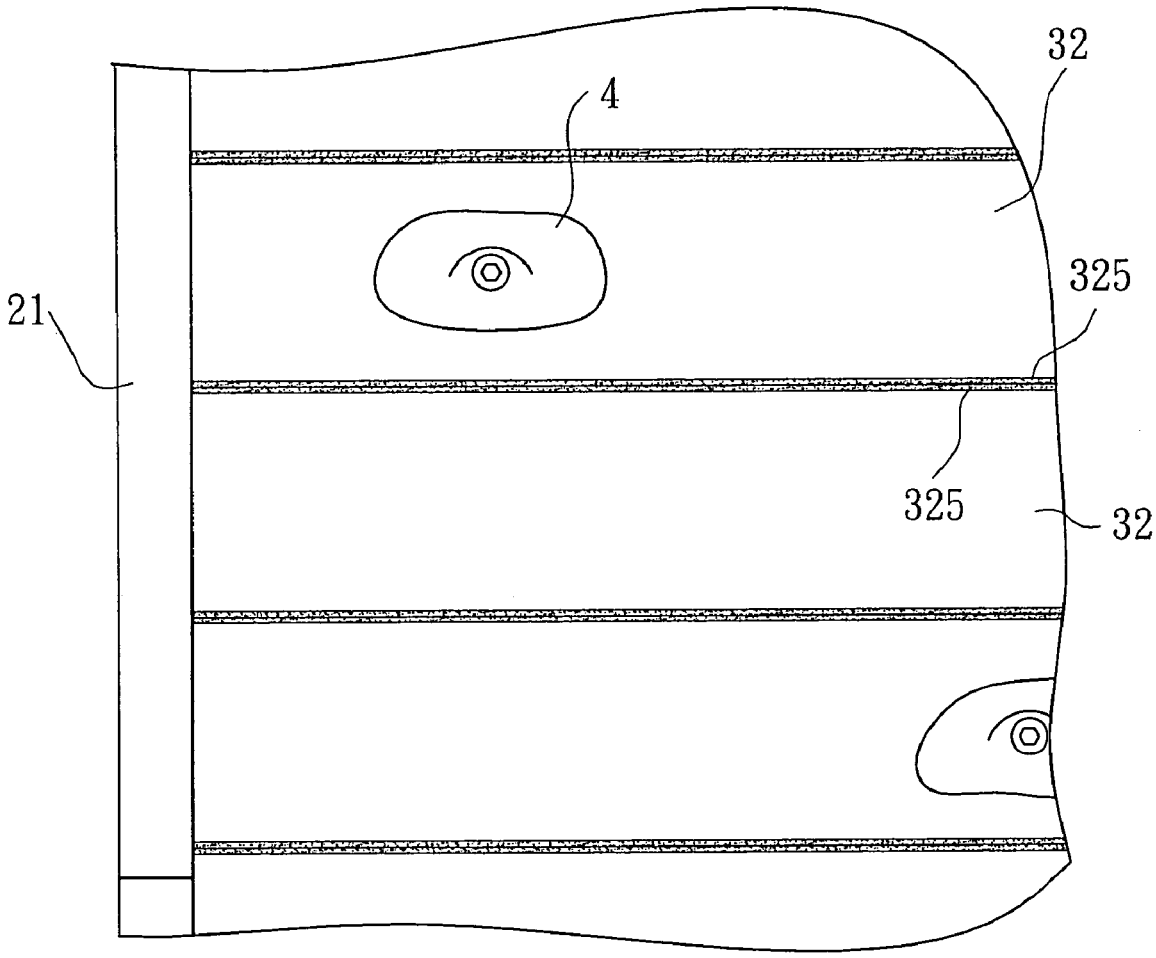
FIG. 11 shows that the resilient strips of the transverse slats of the present invention block the gaps between the transverse slats.
Figure 12:
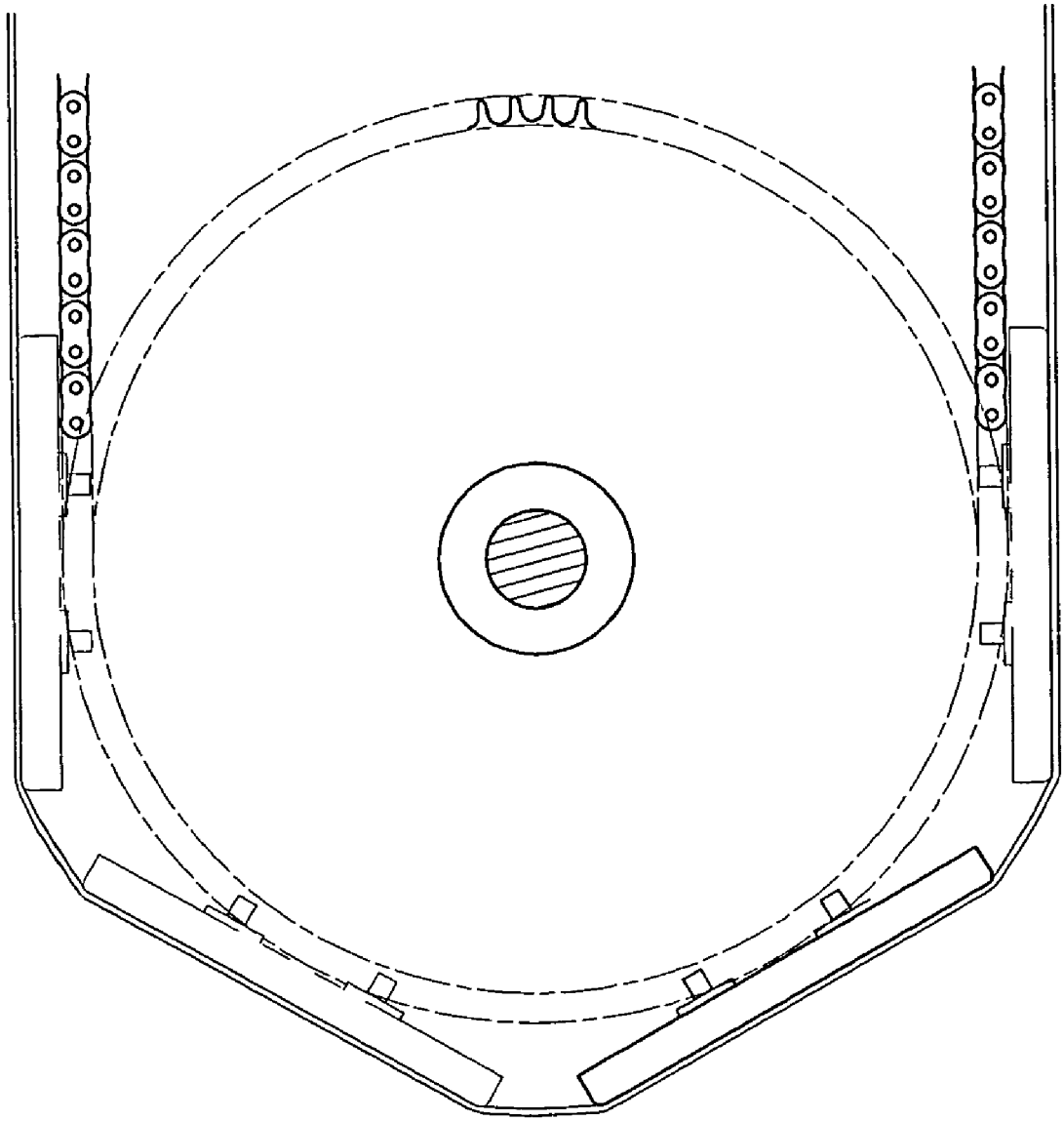
FIG. 12 PRIOR ART
FIG. 12 shows that the soft pad of the conventional rock climbing apparatus is lifted by the transverse beam.

Besides, the transverse slats 32 are immediately adjacent to each other and fixed on the chains 31. Therefore, the transverse slats 32 can shade the transverse support beams 212, the longitudinal support columns 213 and the chains 31 arranged inside the frame body frame 2. In addition, the resilient strips 325 are disposed on the sidewalls 321 of the transverse slats 32, whereby the resilient strips 325 of the adjacent transverse slats 32 can resiliently abut against each other so as to block the gap between the adjacent transverse slats 22 as shown in FIG. 11. Therefore, the hairs or clothes of a user is prevented from being chucked in the gap. Accordingly, the conventional soft pad can be omitted to eliminate the shortcomings caused by the soft pad.

Moreover, the transverse slats 32 are immediately adjacent to each other and fixed on the chains 31. When the transverse slats 32 revolve to the shaft rods 34, the adjacent transverse slats 32 will depart from each other to form a gap. Several polygonal stopper blocks 37 are arranged on the shaft rods 34 for blocking the gaps between the adjacent transverse slats 32 so as to prevent the user's feet from incautiously extending into the gaps. Therefore, the safety in use can be ensured.

Besides, the antiwear jacket 326 is fitted on each end of the transverse slat 32 extending into the lateral column 21 of the main body frame 2. The antiwear jacket 326 is made of antiwear material. Therefore, when the transverse slat 32 circularly revolves along the inner edges of the open sides 211 of the lateral columns 21, the antiwear jackets 326 abut against the inner edges of the open sides 211 to enhance the lubrication and reduce the noise caused by friction.

The above embodiments are only used to illustrate the present invention, not intended to limit the scope thereof. Many modifications of the above embodiments can be made without departing from the spirit of the present invention.

What is claimed is:

1. A rock climbing apparatus comprising:

a support stand on which a main body frame is mounted, the support stand serving to support and the main body frame on the ground, the main body frame being an elongated rectangular frame body, two sides of the main body frame respectively having two lateral columns with substantially C-shaped cross-section, opposite faces of the lateral columns being respectively formed with two open sides, several transverse support beams and several longitudinal support columns being built between the open sides of the lateral columns of the main body frame to serve as a support skeleton of the main body frame; and a rotary mechanism arranged in the main body frame, the rotary mechanism including at least two chains in parallel to the length of the main body frame, multiple transverse slats in parallel to the width of the main body frame and a power supply for driving the chains to circularly revolve, each chain being composed of multiple links and link shafts, the chains being positioned near the middle of the main body frame, the longitudinal support columns of the main body frame being arranged in a position where the chains are positioned, each longitudinal support column having a rib rail corresponding to the link shafts of the chain, whereby the link shafts are slidably leant on the rib rail, the transverse slats being fixed on the chains and immediately adjacent to each other, the chains being positioned near the middle of the transverse slats, two ends of each transverse slat respectively extending into the open sides of the lateral columns of the main body frame, whereby the transverse slats can circularly revolve along inner edges of the open sides, several rocks being locked on one face of each transverse slat distal from the chains, whereby a user can climb the rocks with hands and feet.

2. The rock climbing apparatus as claimed in claim 1, wherein the main body frame is composed of an upper, a middle and a lower frame bodies, the middle frame body being pivotally mounted between the lateral supports of the support stand, each frame body having transverse support beams and longitudinal support columns, the adjacent transverse support beams of the frame bodies abutting against and attaching to each other to connect the frame bodies with each other, several locating members and several fixing members being disposed on the connected transverse support beams for locating and fixedly assembling the frame bodies into the main body frame.

3. The rock climbing apparatus as claimed in claim 2, wherein the locating member includes a boss and a hole in which the boss is inserted, the boss and the hole being respectively formed on the connected transverse support beams for locating and assembling the frame bodies into the main body frame.

4. The rock climbing apparatus as claimed in claim 2, wherein two pivot shafts respectively protrude from two sides of the-middle frame body, the pivot shafts cooperating with two shaft seats to pivotally connect the middle frame body with the lateral supports of the support stand, whereby the main body frame can pivotally swing relative to the support stand, two adjustment plates being respectively disposed on two sides of the middle frame body, each adjustment plate having several adjustment holes, each lateral support of the support stand having an insertion pin corresponding to the adjustment hole of the adjustment plate, whereby the insertion pin can be inserted into the adjustment hole to fix the main body frame in an inclined position.

5. The rock climbing apparatus as claimed in claim 1, wherein the rotary mechanism includes three chains in parallel to the length of the main body frame, the rotary mechanism further including two shaft rods, several sprockets disposed on the shaft rods corresponding to the chains and a tension adjustment unit for adjusting the tension of the chains, the shaft rods being connected between two sides of the main body frame in parallel to each other, the middle of each shaft rod being retained by several support members, each chain being wound around a pair of corresponding sprockets, each chain having multiple lugs arranged at intervals and connected with the links for locking the transverse slats.

6. The rock climbing apparatus as claimed in claim 5, wherein the tension adjustment unit includes a movable seat pivotally connected at each end of one shaft rod, the movable seat being movable along the lateral column of the main body frame, an axially extensible adjustment bolt being disposed under the movable seat, the adjustment bolt being extensible to change the position of the movable seat, whereby the tension of the chains is adjustable, the power supply being a frequency-changing motor with a reducer, the power supply being mounted at one end of the other shaft rod and connected with the shaft rod for driving the shaft rod to rotate and further driving the chains to circularly revolve.

7. The rock climbing apparatus as claimed in claim 6, wherein several stopper blocks are disposed on a body of the shaft rod with the power supply.

8. The rock climbing apparatus as claimed in claim 7, wherein each stopper block has a substantially polygonal cross-section.

9. The rock climbing apparatus as claimed in claim 5, wherein an antiwear jacket is fitted on each end of the transverse slat extending into the lateral column of the main body frame, whereby when the transverse slat circularly revolves along the inner edges of the open sides of the lateral columns, the antiwear jackets abut against the inner edges of the open sides to enhance the lubrication and reduce the noise caused by friction.

10. The rock climbing apparatus as claimed in claim 1, wherein the transverse slat is an elongated slat made by extrusion, the cross-section of the transverse slat being substantially U-shaped, each transverse slat having two sidewalls respectively perpendicularly extending from two sides of the transverse slat, each transverse slat further having a receiving seat lengthwise extending between the sidewalls in parallel thereto, several nuts being accommodated in the receiving seat, whereby several bolts can extend through the rocks to screw into the nuts for fixing the rocks on the transverse slat.

11. The rock climbing apparatus as claimed in claim 10, wherein a soft resilient strip is disposed on each sidewall of the transverse slat for abutting against another resilient strip of an adjacent transverse slat so as to block the gap between the adjacent transverse slats.

12. The rock climbing apparatus as claimed in claim 1, wherein the support stand has a base rested on the ground and two lateral supports respectively upward extending from two sides of the base, the main body frame being pivotally mounted between the two lateral supports.

* * * * *